US005426811A

United States Patent [19]

Walton et al.

[11] Patent Number: 5,426,811

[45] Date of Patent: Jun. 27, 1995

[54] METHOD AND APPARTUS FOR CLEANING HAIR CLIPPER BLADES

[75] Inventors: William M. Walton, Rockford; Gregory S. Wahl; John F. Wahl, both of Sterling, all of Ill.

[73] Assignee: Wahl Clipper Corporation, Sterling, Ill.

[21] Appl. No.: 687,369

[22] Filed: Apr. 18, 1991

[51] Int. Cl.[6] ..... A47L 25/00

[52] U.S. Cl. ..... 15/236.08; 15/105; 15/142

[58] Field of Search ..... 15/236.08, 236.01, 236.07, 15/142, 105

[56] References Cited

U.S. PATENT DOCUMENTS

| | | | |
|---|---|---|---|
| D. 221,244 | 7/1971 | Lawrence | 15/236.08 |
| D. 271,149 | 10/1983 | Castiglione | 15/236.08 |
| 421,995 | 2/1870 | Reibnitz | 15/236.08 |
| 690,116 | 12/1901 | Muller | 15/236.08 |
| 1,377,484 | 5/1921 | Huneryager | 15/236.08 |
| 1,463,809 | 8/1923 | Fritz | 15/236.08 |
| 2,148,944 | 2/1939 | Helm | 15/236.08 |
| 2,364,333 | 12/1944 | Wisher | 15/236.08 |
| 2,544,310 | 3/1951 | Gerhan | 15/236.08 |
| 2,564,721 | 8/1951 | Raya | 15/236.08 |
| 2,719,316 | 10/1955 | Hauser | 15/236.08 |
| 2,793,390 | 5/1957 | Adsit | 15/167.1 |
| 4,553,279 | 11/1985 | Gassew et al. | 15/105 X |

FOREIGN PATENT DOCUMENTS

| | | |
|---|---|---|
| 200680 | 1/1956 | Australia . |
| 22712 | 6/1967 | Australia . |
| 580311 | 9/1946 | United Kingdom . |
| 725975 | 3/1955 | United Kingdom . |
| 1056094 | 1/1967 | United Kingdom . |
| 1145625 | 6/1969 | United Kingdom . |

*Primary Examiner*—David A. Scherbel
*Assistant Examiner*—Patrick Brinson
*Attorney, Agent, or Firm*—Greer, Burns & Crain, Ltd.

[57] ABSTRACT

A tool for cleaning between hair clipper blades includes an elongated handle with a comb at one end of the handle. The comb has a plurality of spaced teeth separated by openings, and a finger at one end of the comb. In use, the finger is inserted between the clipper blades, separating them so that the comb can be passed through the space between the blades, removing unwanted matter such as uncut hair strands.

14 Claims, 2 Drawing Sheets

METHOD AND APPARTUS FOR CLEANING HAIR CLIPPER BLADES

This invention relates to methods and apparatus for removing hair clippings and other debris from between hair clipper blades, and more particularly, to methods and apparatus by which hair clipper blades can be cleaned without disassembling the blades.

BACKGROUND OF THE INVENTION

Most modern electric hair clippers have a stationary blade and a reciprocating blade. The stationary blade has a substantially straight row of spaced teeth, and the reciprocating blade has a row of teeth which correspond to and complement the stationary teeth. The reciprocating teeth are pressed against the stationary teeth by spring tension, and move back and forth across the stationary teeth in operation, cutting hair strands which enter spaces between the stationary teeth.

Cut hair strands may tend to accumulate in between the clipper blades with use. Cut hair which remains between the two blades can create a space between the blades which reduces the blades' cutting ability. However, it is difficult to clean the area between the blades with a brush or the like without disassembling the blades. Thus, there is a need for methods and apparatus for more easily and efficiently removing cut hair strands from between the blades in hair clippers. There is also a need for methods and apparatus for cleaning between the blades in hair clippers without disassembling the blades.

Accordingly, one object of this invention is to provide new and improved methods and apparatus for removing cut hair strands and other debris from between hair clipper blades.

Another object is to provide new and improved methods and apparatus for more easily and efficiently cleaning between the blades in hair clippers, without disassembling the blades.

SUMMARY OF THE INVENTION

In keeping with one aspect of this invention, a tool for removing cut hair strands from between hair clipper blades includes an elongated handle with a blade cleaning comb at one end of the handle. The comb has a plurality of spaced teeth separated by openings. A finger at one end of the comb extends away from the comb perpendicular to the comb teeth and parallel to the plane of the teeth. A recessed portion is provided beneath the finger. The tips of the comb teeth can be secured together or separated, and the recessed portion can have a tapered area. In use, the finger is wedged between the blades, separating them. The comb is then passed through the space the finger creates between the two blades, removing cut hair strands and other unwanted matter. When the tool is removed, the blades return to their original position.

BRIEF DESCRIPTION OF THE DRAWINGS

The above mentioned and other features of this invention and the manner of obtaining them will become more apparent, and will be best understood by reference to the following description, taken in conjunction with the accompanying drawings, in which.

DETAILED DESCRIPTION

Figure 1:
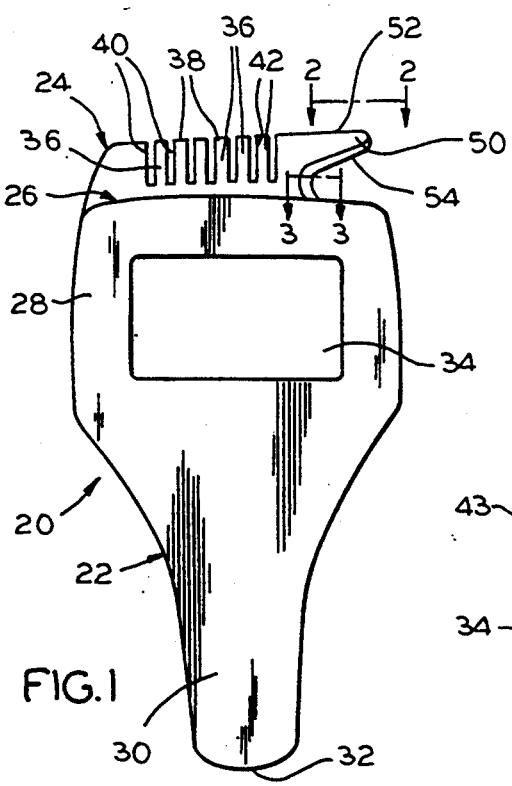
FIG. 1 is a front view of apparatus made in accordance with the principles of this invention.

As seen in FIG. 1, apparatus 20 is a tool for removing unwanted matter such as cut hair strands and the like from in between the cutting surfaces of the blades of a hair clipper. The apparatus 20 includes a handle 22 and a comb 24 located at an end 26 of the handle 22. A portion 28 of the handle 22 is relatively wide, while a portion 30 is tapered to a narrow end 32. An opening 34 may be provided in the handle 22, if desired, for removing detachable blade sets from hair clipper handles. A peripheral rib may also be provided to add structural strength to the apparatus 20 if desired.

Figure 5:
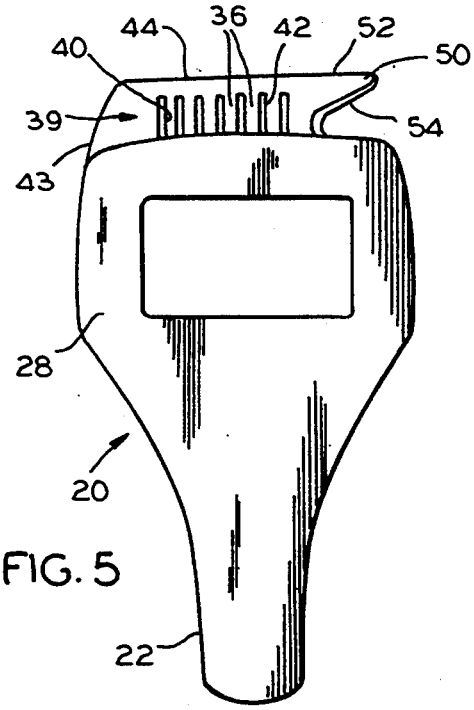
FIG. 5 is a front view of an alternate embodiment of the apparatus shown in FIG. 1.

The comb 24 includes a body 39, outer surfaces 41, 43 and a plurality of spaced teeth 36 separated by openings 40. The openings 40 preferably have relatively sharp edges 42. The comb teeth 36 have tips 38, which can be separated by the openings 40, as in FIG. 1, or secured to each other, as in FIG. 5.

The comb 24 also includes a finger 50 which extends from an end 52 of the comb 24 perpendicular to the teeth 36, but parallel to the plane created by the teeth 36. The finger 50 is generally contiguous with the tips 38, and forms a recessed portion 54 adjacent the body 39 (FIG. 2).

Figure 2:
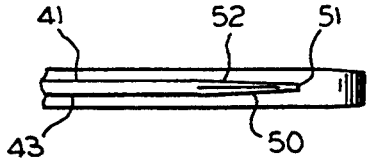
FIG. 2 is sectional view of the apparatus of FIG. 1, taken along lines 2—2 in FIG. 1.
Figure 3:
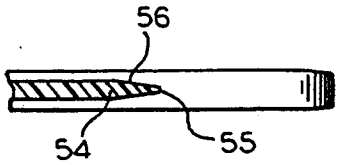
FIG. 3 is a sectional view of the apparatus of FIG. 1, taken along lines 3—3 in FIG. 1.
Figure 4:
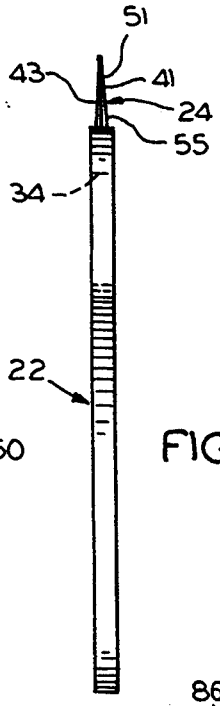
FIG. 4 is a side view of the apparatus of FIG. 1.

The finger 50 and the recessed portion 54 are shown in greater detail in FIG. 2. The finger 50 is tapered inwardly towards an end 51, and is also tapered inwardly towards the teeth tips 38, as shown in FIG. 4. The recessed portion 54 may include a tapered area 56, if desired, in which the recessed portion 54 tapers inwardly towards an edge 55, as seen in FIG. 3.

Figure 6:
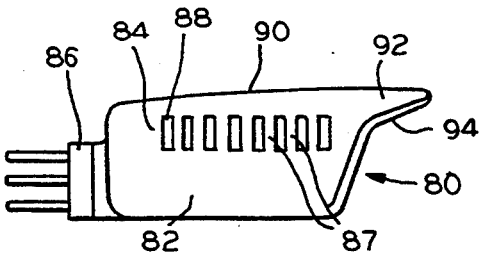
FIG. 6 is a front view of another alternate embodiment of the apparatus of FIG. 1.

Another tool for removing unwanted matter from hair clippers is shown in FIG. 6. There, apparatus 80 includes a handle 82, a comb portion 84 and a brush 86. The comb portion 84 includes a plurality of spaced teeth 87 separated by openings 88, which do not extend to an upper edge 90, and a finger 92, which extends from the upper edge 90. The openings 88 could extend to the edge 90, if desired, and a recessed portion 94 can be provided beneath the finger 92.

Figure 7:
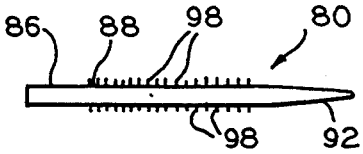
FIG. 7 is a side view of an alternate embodiment of the apparatus of FIG. 6, with the brush removed.
Figure 8:
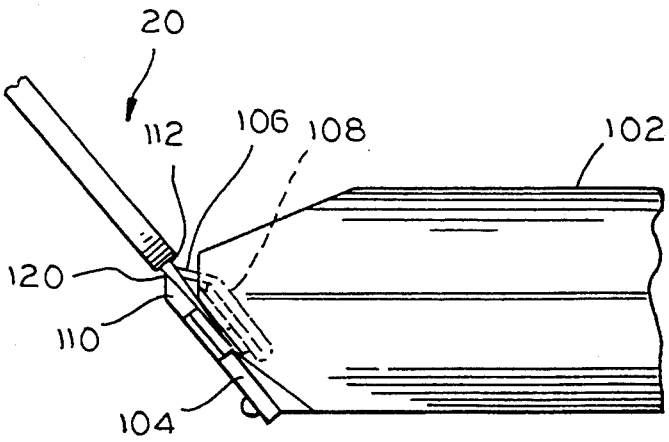
FIG. 8 is a side view of a hair clipper, with the apparatus of FIG. 1 inserted between the blades.

As seen in FIG. 7, a plurality of relatively small protrusions 98 can be added to the comb portion 88 (FIG. 8). Such protrusions can be added to the comb 24 (FIGS. 1 and 5), as well. The protrusions 98 can be adjacent the edges 42, or any other suitable place.

Figure 9:
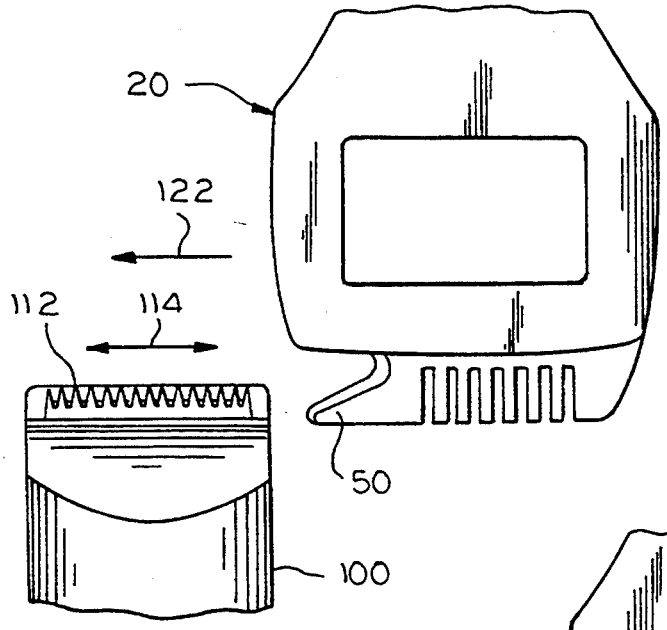
FIG. 9 is a front view of the apparatus of FIG. 1, as it is inserted between the blades of a hair clipper.
Figure 10:
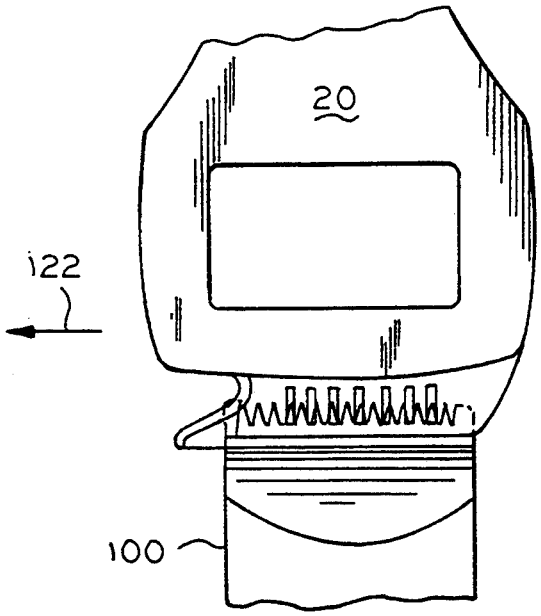
FIG. 10 is a front view of the apparatus of FIG. 1, as it is passed between the blades of a hair clipper.

The apparatus 20 may be used to clean between hair clipper blades of the type shown in FIGS. 8, 9 and 10. A hair clipper 100 includes a handle 102, a stationary blade 104, a reciprocating blade 106 and a spring 108. The stationary blade 104 and reciprocating blade 106 each have a row of teeth 110, 112, respectively, which complement each other so that when the reciprocating blade 106 moves back and forth laterally in the directions of arrow 114 (FIG. 9), hair strands which enter spaces between the stationary teeth 110 are cut by the teeth 112. The spring 108 presses the teeth 112 against the teeth 110 for cutting purposes, while still allowing the reciprocating blade 106 to move back and forth in the directions shown by the arrow 114. In use, however, cut hair strands and other unwanted matter may accumulate between the blades 110, 112, in an area 120 (FIG. 8). If not removed, these hair clippings can spread the blades so that additional hair strands which enter the blade teeth are not cut.

The apparatus 20 is used to clean the area 120 by inserting the finger 50 between the blades 110 and 112, separating them so that the comb 24 can enter the space 120. The end 51 is pressed between the blades just below the teeth of the blades, and the recessed portion 54 passes between the blade teeth. The taper on the recessed portion 54 eases entry between the blades.

The tool 20 is then passed between the blades in the direction of the arrow 122 (FIGS. 9 and 10), and unwanted cut hair strands and the like in the space 120 are removed. When the comb is removed, the spring 108 presses the blades 104, 106 together again. This process can be repeated as often as necessary.

The cut hair strands are removed by the finger 50, the recessed portion 54, the comb teeth 36 and the protrusions 98, if used. The apparatus 20 can be inserted between the blades from either side of the clipper 100. Also, the upward taper of the outer surfaces 41, 43 of the comb 24 towards the outer edge 51 in FIG. 4 may be set so that the outer surfaces are substantially flush with the inside surfaces of the blades 110, 112. Such a taper is used because the blades are secured inside the clipper, and are spread by the comb only at the blade teeth, creating an angle between the inside blade surfaces.

The many advantages of this invention are now apparent. Hair clippings which accumulate between the clipper blades can be removed easily and efficiently, without disassembling the blades. Users are more likely to clean the blades often, improving both performance and reliability.

While the principles of the invention have been described above in connection with specific apparatus and applications, it is to be understood that this description is made only by way of example and not as a limitation on the scope of the invention.

We claim:

1. Apparatus for removing unwanted matter from between a pair of opposing blades of a hair trimming device, at least one of said blades being reciprocal, the blades being forced together by a pressing means, the apparatus comprising:

a handle;

means connected to a selected side of one end of said handle for separating the blades without removing the pressing means; and means connected to said side of said end of said handle for removing the unwanted matter from between the separated blades, without removing the pressing means, said removal means having a plurality of substantially straight teeth extending generally in one direction and forming substantially aligned tips, said teeth being spaced generally along a plane and having relatively sharp, substantially parallel edges, said edges of adjacent teeth defining openings between said teeth, said edges being in said plane and generally perpendicular to a line formed by said tips, said edges scraping unwanted matter from between said blades into said openings between said teeth, said blade separating means including a finger extending from one end of said removal means substantially along said plane and generally parallel to said line and forming an outside end, said finger including at least one tapering surface to form a tapering portion extending toward said outside end, said tapered finger being disposed in relation to said teeth to be easily insertable between the pair of blades, so that said finger and said teeth remove the unwanted material as said finger and teeth are passed between the pair of blades.

2. The apparatus of claim 1 wherein said removal means comprises a comb, said plurality of spaced teeth being separated by openings.

3. The apparatus of claim 1 wherein said finger extends substantially perpendicular to said teeth.

4. The apparatus of claim 1 wherein said finger has a recessed portion, said recessed portion being tapered inwardly towards the outside edge of said finger.

5. The apparatus of claim 1 wherein said comb teeth have tips which are separated from each other.

6. The apparatus of claim 1 wherein each blade of the pair of blades has a cutting portion which forms an inner surface, said teeth having first and second outer surfaces joined at an outer edge, said outer surfaces being tapered towards said outer edge in a substantially straight, continuous tape so that said outer surfaces are substantially flush with the inner surfaces of said blades when said outer surfaces are passed between the blades to remove the unwanted matter from between the separated blades.

7. A cleaning tool for a hair clipper, the hair clipper having a pair of blades which are pressed together by a spring, the tool comprising:

a handle, and a comb at one end of said handle, said comb having means for separating the blades no insert said comb between the blades, without removing the spring, said comb forming a plane, said blade separating means including a finger extending from one end of said comb generally parallel to said plane and forming an outside end, said finger including at least one tapering surface to form a tapering portion extending toward said outside end, whereby said finger may be easily inserted between the pair of blades.

8. The tool of claim 7 wherein said comb has a plurality of spaced teeth separated by openings, said finger extending substantially perpendicular to said comb teeth and substantially parallel to a plane formed by said teeth.

9. The tool of claim 8 wherein said comb teeth have tips which are separated from each other.

10. The tool of claim 7 wherein said finger has a recessed portion, said recessed portion being tapered inwardly towards the outside edge of said finger.

11. The tool of claim 7 wherein each blade of the pair of blades of the clipper has a cutting portion which forms an inner surface, said comb has first and second outer surfaces joined at an outer edge, said outer surfaces being tapered towards said outer edge in a substantially straight, continuous taper so that said outer surfaces are substantially flush with the inner surfaces of said blades when said outer surfaces are passed between the blades to remove the unwanted matter from between the separated blades.

12. Apparatus for removing unwanted matter from between a pair of opposing blades, at least one of the blades being reciprocal, the blades being forced together by a pressing means, the apparatus comprising:

means for separating the blades without removing the pressing means, and means for removing the unwanted matter from between the separated blades, without removing the pressing means, said removal means having a plurality of teeth extending generally in one direction and forming substantially aligned tips, said teeth being spaced generally along a plane, and having tips which are secured to each other and form openings between said teeth and below said secured tips, said blade separating means including a finger extending from one end of said removal means substantially along said plane and forming an outside end, said finger including at least one tapering surface to form a tapering portion extending toward said outside end whereby said finger may be easily inserted between the pair of blades.

13. A cleaning tool for a hair clipper, the hair clipper having a pair of blades which are pressed together by a spring, the tool comprising:

a handle, and a comb at one end of said handle, said comb having a plurality of spaced teeth separated by openings, said comb teeth having outer tips which are secured to each other, and means for separating the blades to insert said comb between the blades, without removing the spring, said blade separating means including a finger extending from one end of said comb and forming an outside end, said finger extending substantially perpendicular to said comb teeth and substantially parallel to a plane formed by said teeth, said finger including at least one tapering surface to form a tapering portion extending toward said outside end, whereby said finger may be easily inserted between the pair of blades.

14. A cleaning tool for a hair clipper, the hair clipper having a pair of blades which are pressed together by a spring, the tool comprising:

a handle, and a comb at one end of said handle, said comb having a plurality of teeth and separate protrusions generally perpendicular to said teeth and means for separating the blades to insert said comb between the blades, without removing the spring, said blade separating means including a finger extending from one end of said comb and forming an outside end, said finger including at least one tapering surface to form a tapering portion extending toward said outside end, whereby said finger may be easily inserted between the pair of blades.

* * * * *

UNITED STATES PATENT AND TRADEMARK OFFICE

CERTIFICATE OF CORRECTION

PATENT NO. : 5,426,811
DATED : June 27, 1995
INVENTOR(S) : Walton, et al.

It is certified that error appears in the above-indentified patent and that said Letters Patent is hereby corrected as shown below:

In column 4, line 32, delete "tape" insert --taper--.

In column 4, line 42, delete "no" and insert --to--.

Signed and Sealed this

Seventeenth Day of October, 1995

*Attest:*

Bruce Lehman

BRUCE LEHMAN

*Attesting Officer*

*Commissioner of Patents and Trademarks*